United States Patent [19]

Yeager et al.

[11] Patent Number: 4,538,390

[45] Date of Patent: Sep. 3, 1985

[54] INSULATION AND PARTITION MEANS FOR EXISTING BUILDING

[75] Inventors: Raymond W. Yeager, Pataskala; Bradley W. Oberg, Granville, both of Ohio

[73] Assignee: Owens-Corning Fiberglas Corporation, Toledo, Ohio

[21] Appl. No.: 430,192

[22] Filed: Sep. 30, 1982

[51] Int. Cl.[3] ..... E04H 1/00

[52] U.S. Cl. ..... 52/221; 52/144; 52/242; 52/281; 181/290

[58] Field of Search ..... 52/145, 242, 241, 238, 52/509, 410, 512, 221, 281, 562, 144; 181/290, 281

[56] References Cited

U.S. PATENT DOCUMENTS

| | | | |
|---|---|---|---|
| 2,228,152 | 1/1941 | Patten | 52/747 |
| 2,996,138 | 8/1961 | Schwartz | 181/284 |
| 3,411,252 | 11/1968 | Boyle | 52/242 |
| 3,683,575 | 8/1972 | Meziere | 52/241 |
| 3,729,883 | 5/1973 | Thompson | 52/241 |
| 3,900,996 | 8/1975 | Yohe | 52/241 |
| 4,114,333 | 9/1978 | Jones | 52/281 |
| 4,306,396 | 12/1981 | Iotti | 52/238.1 |
| 4,437,542 | 3/1984 | Yeager | 52/144 |
| 4,441,580 | 4/1984 | Webster | 181/286 |

*Primary Examiner*—John E. Murtagh
*Assistant Examiner*—Kathryn L. Ford
*Attorney, Agent, or Firm*—Ronald C. Hudgens; Ted C. Gillespie; Paul J. Rose

[57] ABSTRACT

H-splines and electrical raceways useful in an insulation system for the inner side of an exterior wall are substantially identical to those in a partition wall constructed to extend from said exterior wall. Insulation panels in the insulation system and in the partition wall may also be substantially identical.

5 Claims, 6 Drawing Figures

INSULATION AND PARTITION MEANS FOR EXISTING BUILDING

TECHNICAL FIELD

This invention relates to retrofit insulation systems for the inner sides of exterior walls of existing buildings and partition walls compatible therewith.

BACKGROUND ART

Increasing cost of energy for heating and cooling air in commercial buildings has created a need for a system of thermally insulating exterior walls of existing buildings. With an insulation system applied to the inner sides of such exterior walls, it would be desirable if duplicate components of the insulation system could be used to build partition walls.

DISCLOSURE OF INVENTION

In accordance with the invention, an insulating system for the inside of exterior walls of existing buildings is provided, and duplicate components of the insulation system can be used to build interior partition walls. Both the insulation system and interior partition walls include electrical wiring raceways.

BRIEF DESCRIPTION OF DRAWINGS

The invention is hereinafter described in greater detail with reference being taken to the accompanying drawings in which.

BEST MODE OF CARRYING OUT THE INVENTION

Figure 1:
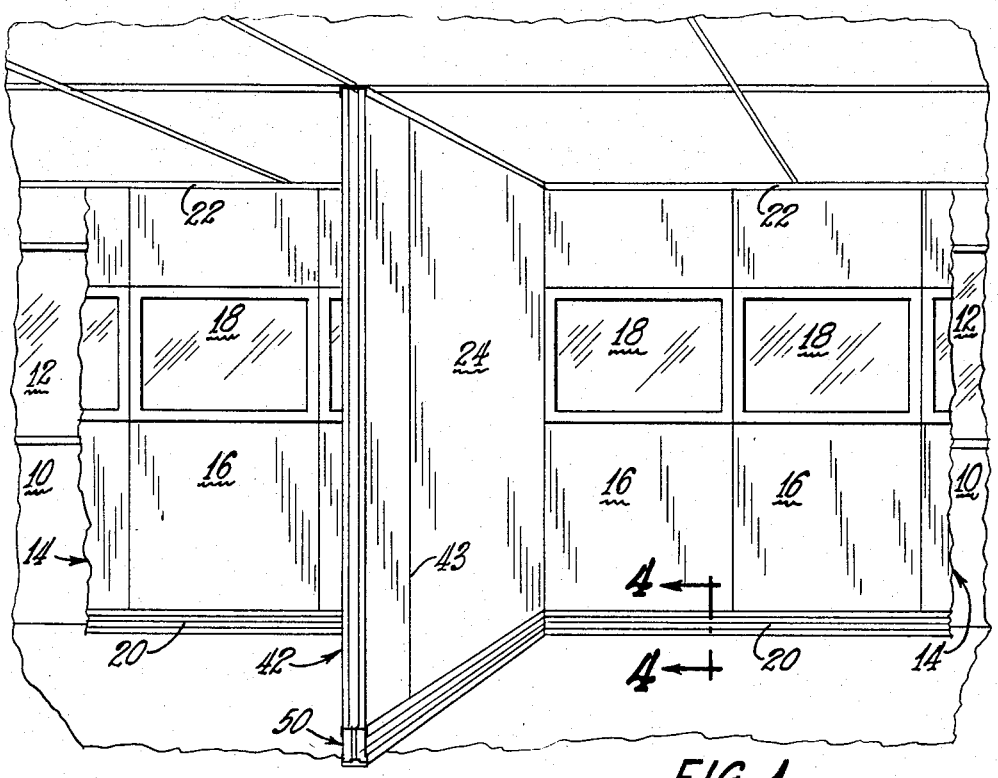
FIG. 1 is a fragmentary perspective view of the inner side of an exterior wall with an insulation system mounted thereon and a partition wall using duplicate components of the insulation system in accordance with the invention.
Figure 3:
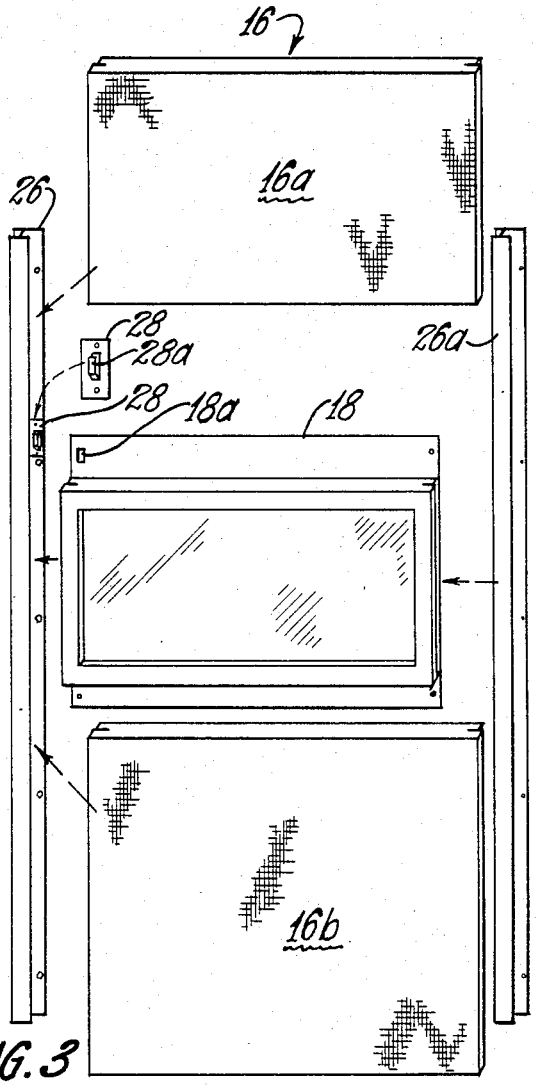
FIG. 3 is an exploded perspective view of an insulation panel with a window and two mounting splines forming part of a retrofit insulation system in accordance with the invention.

With reference to the drawings, FIG. 1 shows the inner side of an exterior wall 10 of an existing building having windows 12 therein. In accordance with the invention, a retrofit insulation system 14 is installed on the wall 10. As shown in FIG. 1, the system 14 includes a plurality of panels 16 having windows 18. The panels 16 are set in lower trim channels 20 and upper trim channels 22, the construction of the lower trim channels 20 being shown in FIG. 4 and the construction of the panels 16 being shown in FIG. 3.

Figure 2:
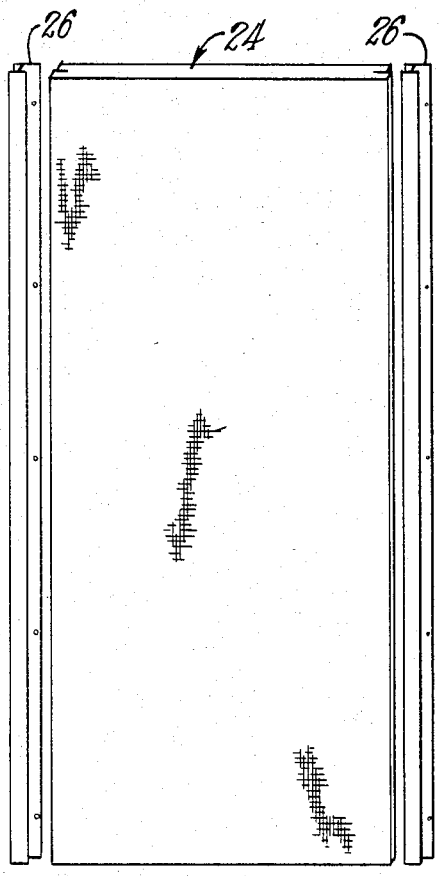
FIG. 2 is an exploded perspective view of a windowless insulation panel and two mounting splines forming part of a retrofit insulation system in accordance with the invention.

In areas (not shown) of the wall 10 where there are no windows 12, windowless panels such as a windowless panel 24 shown in FIG. 2 are installed. The panels 24 are mounted on the wall 10 by means of conventional concealed mounting splines 26 of generally H-shaped cross section. Although the trim channels 20 and 22 are sufficient to hold the panels 24 generally upright, the H-splines 26 prevent sagging or curvature away from the wall 10. One side portion of an H-spline 26 is secured to the wall 10 in any suitable manner and the other side portion is concealed in appropriate slots in vertical edge portions of an adjacent two of the panels 24. A panel 24 forming part of a partition wall 42 having a joint 43 and a dual lower trim channel 50 is shown in FIG. 1, the partition wall 42 not forming part of the insulation system 14.

The panels 16 are assembled at the job site. A bracket 28 (FIG. 3) is rivetted to an H-spline 26. The bracket 28 is shown rivetted to an H-spline 26 and is also shown separately in an enlarged view. The bracket 28 includes a hook 28*a*. After an H-spline 26 with a bracket 28 secured thereto is fastened to the wall 10, a metal framed window 18 is hung on the hook 28*a* at a hole 18*a* in the metal frame. Panel portions 16*a* and 16*b* are then put in place respectively above and below the window 18, and another H-spline 26*a* is installed on the wall 10 to retain the panel portions 16*a* and 16*b* in position. If another windowed panel 16 is to follow, a bracket 28 is first rivetted to the H-spline 26*a*.

The panel portions 16*a* and 16*b* may be cut from panels such as the panel 24. The panels are preferably thermally insulating sound absorbent glass fiber boards covered with decorative cloth.

Figure 4:
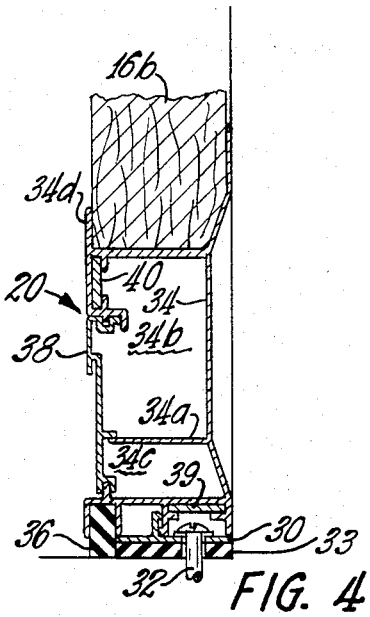
FIG. 4 is a vertical sectional view of a lower trim channel forming part of the retrofit insulation system of the invention, taken generally along the line 4—4 of FIG. 1.

A lower trim channel 20 is shown in section in FIG. 4. The trim channel 20 includes a mounting strip 30 secured to a floor by fasteners such as screws 32, one of which is shown, over an elastomeric sealing strip 33, a raceway body portion 34 mounted on the mounting strip 30 and retaining a second elastomeric sealing strip 36, and a snap-on cover 38. Alignment plates 39 and 40 are provided at joints between sections of body portions 34. A divider 34*a* of the body 34 partially defines an upper raceway 34*b* and a lower raceway 34*c* for separately housing power and communication wires. A lip 34*d* retains the lower portion of panel portions 16*b* or panels 24.

Figure 5:
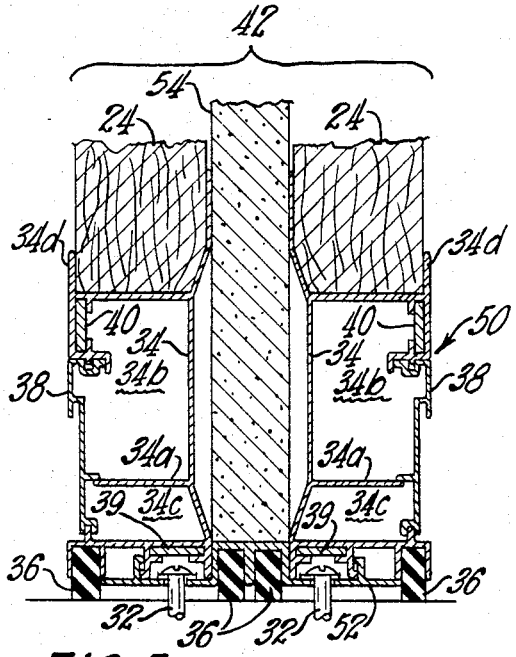
FIG. 5 is a fragmentary vertical sectional view of a partition wall using duplicate components of the retrofit insulation system in accordance with the invention.

FIG. 5 is a view similar to FIG. 4, but is taken through the dual lower trim channel 50 of the partition wall 42 of FIG. 1, the trim channel 50 being essentially a dual arrangement of trim channel 20 of the insulation system 14, with duplicate parts in FIGS. 4 and 5 being identically numbered. The trim channel 50 includes a mounting strip 52 secured to the floor by pairs of the screws 32 and retaining a pair of the elastomeric sealing strips 36 between the screws 32. A septum 54, preferably of gypsum board, is mounted above the center of the strip 52 between two of the raceway body portions 34. Windowless panels 24 are mounted on the body portions 34 respectively on opposite sides of the septum 54.

Figure 6:
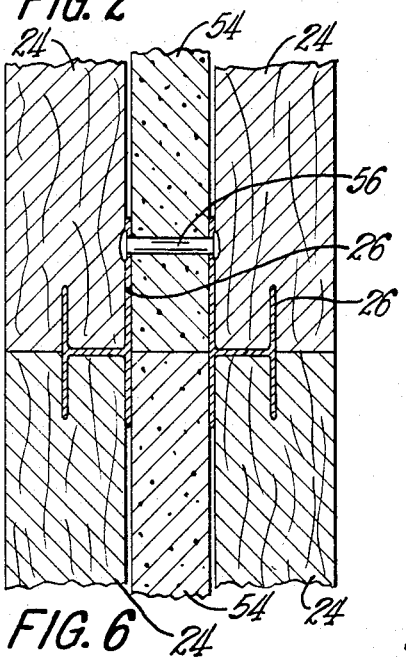
FIG. 6 is a fragmentary horizontal sectional view through the partition wall of FIGS. 1 and 5 at a joint.

FIG. 6 shows a horizontal section through the partition wall 42 at the joint 43. A rivet 56 holds two of the H-splines 26 together on opposite sides of the septums 54, and the panels 24 are held by the H-splines.

It will be seen that the partition wall 42 includes H-splines 26, screws 32, raceway body portions 34, sealing strips 36, covers 38, and alignment plates 39 and 40, all of these being parts substantially identical to those used in the retrofit insulation system 14 for the exterior wall 10. The panels 24 in the partition wall 42 and in the insulation system 14 may also be substantially identical.

Various modifications may be made in the structure shown and described without departing from the scope of the invention as set forth in the following claims.

We claim:

1. A retrofit outer wall insulation and partition wall means for a preexisting building, said means comprising an insulation system applied to an inner side of an exterior wall of the preexisting building and including an enclosed electrical raceway, sound absorbent thermally insulating fibrous glass panels, and H-splines, the H-splines being secured vertically to said exterior wall and retaining the panels to the exterior wall by cooperative engagement with vertical edge portions thereof and the raceway forming a lower trim for the panels, and a partition wall installed in the preexisting building, extending perpendicularly inwardly from the exterior wall, and including two spaced-apart enclosed electrical raceways oriented in back-to-back relationship to each other, a pair of adjacent septum panels each having a lower end portion disposed between the spaced-apart enclosed electrical raceways and extending upwardly therefrom, pairs of sound absorbent thermally insulating fibrous glass panels disposed respectively in engagement with opposite sides of the septum panels and respectively having said two spaced-apart enclosed electrical raceways for lower trim, and a pair of spaced-apart H-splines oriented in back-to-back relationship to each other with the septum panels therebetween, each H-spline of the partition wall being disposed at a joint between the septum panels and cooperatively engaging vertical edge portions of adjacent ones of the fibrous glass panels of the partition wall, the H-splines of the partition wall having cross sections identical to the cross sections of the H-splines of the insulation system on the exterior wall, and each of the two enclosed electrical raceways of the partition wall having a cross section identical to the cross section of the enclosed electrical raceway of the insulation system on the exterior wall.

2. An insulation and partition means as claimed in claim 1 wherein the panels of the insulation system and the panels of the partition wall are substantially identical.

3. A joint structure for a floor-to-ceiling partition wall of the type having a sound barrier septum and sound absorbent panels on opposite sides of the septum, the joint structure comprising a pair of adjacent sound barrier septum members in vertical-edge-to-vertical-edge relationship, a pair of vertically extending generally H-shaped splines disposed respectively on opposite sides of the septum members with flanges of the splines parallel to the septum members and an inner flange of each spline overlapping adjacent vertical edges of the septum members, and two pairs of sound absorbent panels, one pair being retained on one side of the septum members by one of the splines and the other pair being retained on the other side of the septum members by the other of the splines, each sound absorbent panel having a slotted edge in which a portion of an outer flange of a respective spline is received, and the splines being secured to each other by fastening means extending through one of the septum members and through the inner flanges of the splines.

4. A joint structure as claimed in claim 3 wherein the septum members are gypsum boards.

5. A joint structure as claimed in claim 3 wherein the sound absorbent panels are glass fiber boards covered with decorative cloth.

* * * * *